United States Patent [19]

Baus

[11] Patent Number: 4,485,730

[45] Date of Patent: Dec. 4, 1984

[54] VENTILATION UNIT

[76] Inventor: Heinz G. Baus, Wartbodenstrasse 35, CH-3626 Hünibach-Thun, Switzerland

[21] Appl. No.: 360,654

[22] Filed: Mar. 22, 1982

[30] Foreign Application Priority Data

Mar. 28, 1981 [DE] Fed. Rep. of Germany ..... 3112310

[51] Int. Cl.[3] ..... F24F 13/18

[52] U.S. Cl. ..... 98/118; 98/97

[58] Field of Search ..... 98/32, 37, 40 A, 41, 98/42 R, 88 R, 97, 98, 99.6, 99.8, 101, 118

[56] References Cited

U.S. PATENT DOCUMENTS

| | | | |
|---|---|---|---|
| 836,201 | 11/1906 | McConnell | 98/97 |
| 896,334 | 8/1908 | Stokes | 98/97 |

FOREIGN PATENT DOCUMENTS

| | | | |
|---|---|---|---|
| 237256 | 12/1964 | Austria . | |
| 64413 | 4/1946 | Denmark | 98/37 |
| 1191091 | 4/1965 | Fed. Rep. of Germany . | |
| 1249489 | 9/1967 | Fed. Rep. of Germany . | |
| 2400748 | 7/1974 | Fed. Rep. of Germany . | |
| 523672 | 7/1940 | United Kingdom | 98/41 AV |

*Primary Examiner*—Harold Joyce

*Attorney, Agent, or Firm*—McGlew and Tuttle

[57] ABSTRACT

The invention relates to a ventilation unit in a frame or the like, the said unit comprising a flow-duct and a slide having a leg which opens and closes the said flow-duct, the said slide being adapted to move at least partly back and forth in the said flow-duct, a stop-surface being associated with the leg which possesses a sealing surface. A ventilating unit of this kind is fitted, for example, in a window-frame or an opening in a wall, the slide providing a satisfactory seal in the closed position, since a major energy loss would otherwise have to be feared. The ventilation unit is to be reliable in operation and to provide reliable sealing. In order to solve this problem, it is proposed that the slide be substantially U-shaped, a second leg having a sealing surface being provided in the flow-duct. This second leg extends over a portion of the structural height of the said flow-duct and a stop-surface is associated with sealing surface of the said second leg, a guide-element for the slide being provided on both longitudinal sides of the said flow-duct. The ventilation unit according to the invention thus comprises at least two sealing surfaces, so that, when the slide is closed, satisfactory sealing is assured. The slide is furthermore reliably guided in a simple manner by the said guide-elements, thus ensuring great reliability.

12 Claims, 4 Drawing Figures

VENTILATION UNIT

BACKGROUND OF THE INVENTION

The invention relates to a ventilation unit for mounting throughly a frame or the like, the said unit defining a flow-duct and comprising a slide having a leg which opens and closes the said flow-duct, the said slide being adapted to move at least partly back and forth in the said flow-duct, and a stop-surface being associated with the leg which is provided with a sealing surface.

THE PRIOR ART

German AS 12 49 489 describes a ventilation unit of the aforesaid type designed to be mounted in a window-frame, in the panel of a door, or in an actual wall. In this known unit, a slide is provided which moves in the flow-duct in the frame and serves to open and close the said flow-duct. When the sealing surface of the slide bears against the relevant stop-surface, for example a slotted plate, the flow-duct is closed. If, however, the slide is moved away from the said slotted plate, the flow-duct is opened.

Because of the high cost of heating and power, it is more than ever necessary for the flow of air to be largely shut off in the closed position. In addition to this, problems arise with the known ventilating unit, in that pressure created by strong wind may force the slide out of the closed position. This will obviously result in a large loss of heat since a cold wind, or a flow of cold air can then enter the room from the outside.

THE INVENTION

It is therefore the purpose of the invention to provide a ventilation unit of the type in question in such a manner as to provide reliable sealing with comparatively low production and material cost. In addition to this, when the slide is open, the said ventilating unit must oppose a relatively low resistance to the flow of air, in order to provide satisfactory aeration and deaeration. The unit is also to be compact and, especially, of low structural height. The said unit must additionally have a high degree of functional and operational reliability and must meet service requirements.

According to the invention, this purpose is achieved in that the slide is substantially U-shaped defining a second leg having a sealing surface and extending in the flow-duct; in that the said second leg extends over a portion only of the structural height of the said flow-duct; in that a stop-surface is associated with the sealing surface of the second leg; and in that a guide-element for the slide is preferably provided on both longitudinal sides of the flow-duct, the said guide-element comprising guide-surface associated with the slide.

The ventilation unit according to the invention is characterized by its particularly simple and inexpensive design and ensures reliable closing of the flow-duct. The U-shape of the slide which, according to the invention, defines a second leg, makes it possible to close off the flow-duct at two locations in spatial relationship to each other. In the closed position, a cushion of air builds up between the two spaced-apart legs of the slide, and this acts as an insulating layer between the exterior and the interior of the building. Furthermore, the second leg according to the invention provides a labyrinth-type seal with a high flow resistance. The said slide is moreover easy to produce, in that it requires no vent slots or the like. Since the slide itself, and the guides therefor, are arranged substantially in the flow-duct, functional reliability is assured for a longtime, especially since there is almost no danger of the guides or guiding surfaces being contaminated or damaged. It is expressly emphasized that stop surfaces are provided, on the frame or within the flow-duct, for the two sealing surfaces according to the invention, it being also possible to arrange these stop surfaces in a component having a U-shaped cross-section. In all cases the air-current flows approximately in a sinuous pattern over the said legs of the slide and of the said U-shaped component, thus providing, in a highly advantageous manner, sound-insulation between the outside and the inside. It should also be specially emphasized that the slide, and the component associated therewith, may also have more than three legs each projecting into the flow-duct. From the point of view of flow-resistance, however, the two-legged construction has been found particularly advantageous. However, an increase in the number of legs improves sound and heat insulation, although, as in the case of a labyrinth-seal, the flow-resistance is increased. Thus if sound insulation and heat insulation are matters of importance, the slide, and the frame components associated therewith, may comprise three or more legs without departing from the scope of the invention.

It is desirable for the slide to be arranged in such a manner that it must be moved from the outside to the inside for the purpose of closing off the flow-duct. It is known that air or wind pressure usually acts in this direction, so that even with a high wind outside, the slide cannot be opened by the wind. On the contrary, wind pressure passes the sealing surface of the slide more firmly against the top surface. This prevents irritating rattling or the like.

In one preferred embodiment, the slide comprises a guide-part which bears against an inner part of the flow-duct. This is a simple way of providing a seal between the guide-part and the inner wall of the flow-duct, thus preventing any undesired flow of air in the said area when the slide is closed.

It is desirable for the slide with its sealing surfaces and stop-surfaces to extend substantially over the entire width of the flow-duct. This makes it possible to make the flow-duct in the form of a comparatively elongated but transversely short slot, for example over the width of the window, in order to obtain the necessary flow cross-section. Such long slide and stop-surfaces ensure reliable sealing and closing. Furthermore, a long slide of this kind may be produced very easily and inexpensively, for example by extrusion. This makes it possible to produce the slide in the form of a long extrusion which is subsequently cut to length.

In another preferred embodiment, the leg of the slide extends substantially over the entire structural height of the flow-duct, this leg being moved to provide an opening to the outside or the inside, whereas the other leg, or legs, extend over a portion only of the structural height, preferably about two-thirds thereof. A design of this kind provides a satisfactory compromise between low flow-resistance and comparatively good sound-insulation between the outside and inside.

It is desirable for at least one stop-surface to be arranged upon a facing grid. Such grids usually comprises slats, shutters or the like, on the one hand to protect the flow-duct from large foreign bodies and, on the other hand, to provide a pleasing appearance. If one stop-surface is arranged upon a facing grid of this kind, which is in any case present, this has the advantage of eliminating the need for a separate component for the said stop-surface.

It is desirable for the stop-surface on the said grid to extend over a portion of the structural height, preferably about one third thereof. This is a simple way of matching the heights of the stop-surface and the leg of the slide. Moreover the appearance of the facing grid is scarcely affected by the stop-surface.

It is desirable to provide weather stripping above the flow-duct, preferably on the outside of the frame, in order to protect the slide moving in the outer area and relevant leg. This also prevents rain and larger foreign bodies from entering the flow-duct.

In a preferred embodiment, a guide-element is arranged on either side of the flow-duct, the said elements having guiding surfaces associated with the slide. A guide-element of this kind may be produced inexpensively and provides satisfactory guidance for the slide. Obviously, with a relatively lengthy flow-duct, several guide-elements may be provided if necessary.

It is desirable for the guiding part of the slide to contain grooves or slots in which pins provided in the guide element may engage, or vice-versa. It is a simple matter to provide grooves or slots in the slide and guide-elements. The relevant pins are also easily arranged, without special production costs, in the guide-element or slide. This produces simple and reliable guidance, making it practically impossible for the slide to tilt or become jammed.

The said grooves or slots are preferably arranged obliquely at an angle to the direction of flow and they may, if necessary, be of a predetermined curved shape. At this point it should be emphasized that, depending upon the configuration of the said grooves, in addition to the movement which in according to the invention is in the direction of flow, there is also another movement at right angles thereto, which is a simple way of favourably affecting the opening and closing of the slide. For instance, during opening in particular, the slide may be caused to move initially along a relatively long path, in order to obtain a favourable force-distance ratio.

According to a preferred embodiment, the guide-element has a step, the height of which corresponds approximately to the height of one leg of the slide. Thus the slide is guided, on the one hand, by the edge of the said leg and, on the other hand, by its guiding part and the said guide-element. It is obvious that functional reliability is improved by this multiple guidance.

It is desirable for the said guide-elements to be joined by means of a connecting element, in order to achieve rapid and secure mounting in the frame and flow-duct. The guide-elements may easily be glued to a connecting element of suitable length, permitting reliable adaptation to all relevant lengths and other dimensions. On the other hand, if a large number of parts is involved, the guide and connecting elements may be injection or compresson moulded in one piece from a synthetic material.

It is desirable for the slide to be held in the closed position by means of a spring-element, a suitable actuating means being provided to move the slide against the force of the spring when it is desired to open the flow-duct.

DESCRIPTION OF THE DRAWINGS

Further advantages and characteristics, essential to the invention, of the ventilation unit may be gathered from the embodiments, explained hereinafter in conjunction with the drawings attached hereto, wherein:

FIG. 1 shows an exploded view of a ventilating unit having a slide 2 which is adapted to move back and forth on two guide-elements 4, at least in the direction of arrow 6. Central guiding part 8 of slide 2 contains two slots 10 in which pins 12 in guide-elements 4 engage. Since slots 10 run at an angle to arrow 6, the slide can also carry out a movement at an angle to the direction of arrow 6. A curved design of the said slots is shown in dotted lines, by means of which a favourable adaptation of the force required to move the slide, to the path travelled, may be achieved. For instance, it may be particularly desirable, as the slide is moved from the closed to the open position, to arrange for the slide to travel initially over a short distance only. The direction of arrow 6 coincides with the direction of flow of the air passing through the ventilation unit. Slide 2 comprises two legs 14, 16 united by central guiding part 8, the latter having a lower guiding surface 18 through which the said slide rests upon guiding surfaces 22 of guide-elements 4. The end-face of one leg 16 is also designed as a guiding surface 20 which rests upon further guiding surfaces 24 of element 4. It may thus be seen that functionally reliable guidance of slide 2 is assured. Guide-elements 4 are united by a connecting element 26. It is desirable for the guide- and connecting-elements to be made in one piece, out of a suitable synthetic material, by compression- or injection-moulding. The design of guide-elements 4 is such that a step 28 is provided between guiding surfaces 24 and 22. Also provided is a facing grid 30 which is secured to guide-elements 4 by means of screws 32 or some other fasteners, to which end the end-faces 34 of the said guide-elements have holes 36. When slide 2 rests upon the guide-elements, as shown in dotted lines, this is the closed position, whereas the thin lines show the open position. It will be seen that, in moving from one position to the other, the slide and its guiding surfaces 18, 20 are adequately guided by guiding surfaces 22, 24 on elements 4, thus definitely preventing any tilting or jamming.

FIG. 2 is a section through the ventilating unit according to FIG. 1 which is fitted into a frame 38, more particularly a window-frame or the like. Slide 2 is located in a flow-duct 40 which constitutes, in principle, a connection between the exterior 42 and the interior 44 of the building. It is emphasized in this connection that the ventilating unit is incorporated directly into frame 38, in the flow-duct, with no need for any additional components such as a housing. The saving in costs and materials thus achieved is obvious. Outer leg 14 of slide 2 extends over the entire height H of flow-duct 40. The said slide, and guiding part 8 thereof, bears directly against upper inside wall 46 of flow-duct 40 and against frame 38. As previously mentioned, slide 2 lies upon the two guiding surfaces of elements 4, the latter being arranged along the longitudinal sides of the flow-duct, the figure obviously showing only one guide-element. Sealing surface 48 of leg 14 bears, through a sealing element 50, against a stop-surface 52 of connecting element 26. Like slide 2 as a whole, sealing element 50 runs in the longitudinal direction, i.e. at right angles to the plane of the drawing. It should also be pointed out that guide-elements 4, arranged at the ends of the flow-duct, also form stop-surfaces with which are associated the sealing surfaces of slide 2 located along the lateral edges. Since the guiding part 8 of the said 2, bears almost directly upon inner wall 46, a satisfactory seal is also obtained here. Arrow 54 shows that, with slide 2 in the position shown, there can be practically no exchange of air between exterior 42 and interior 44. Weather-stripping 56 is also provided outside, in order to prevent rain or snow from entering.

Figure 1:
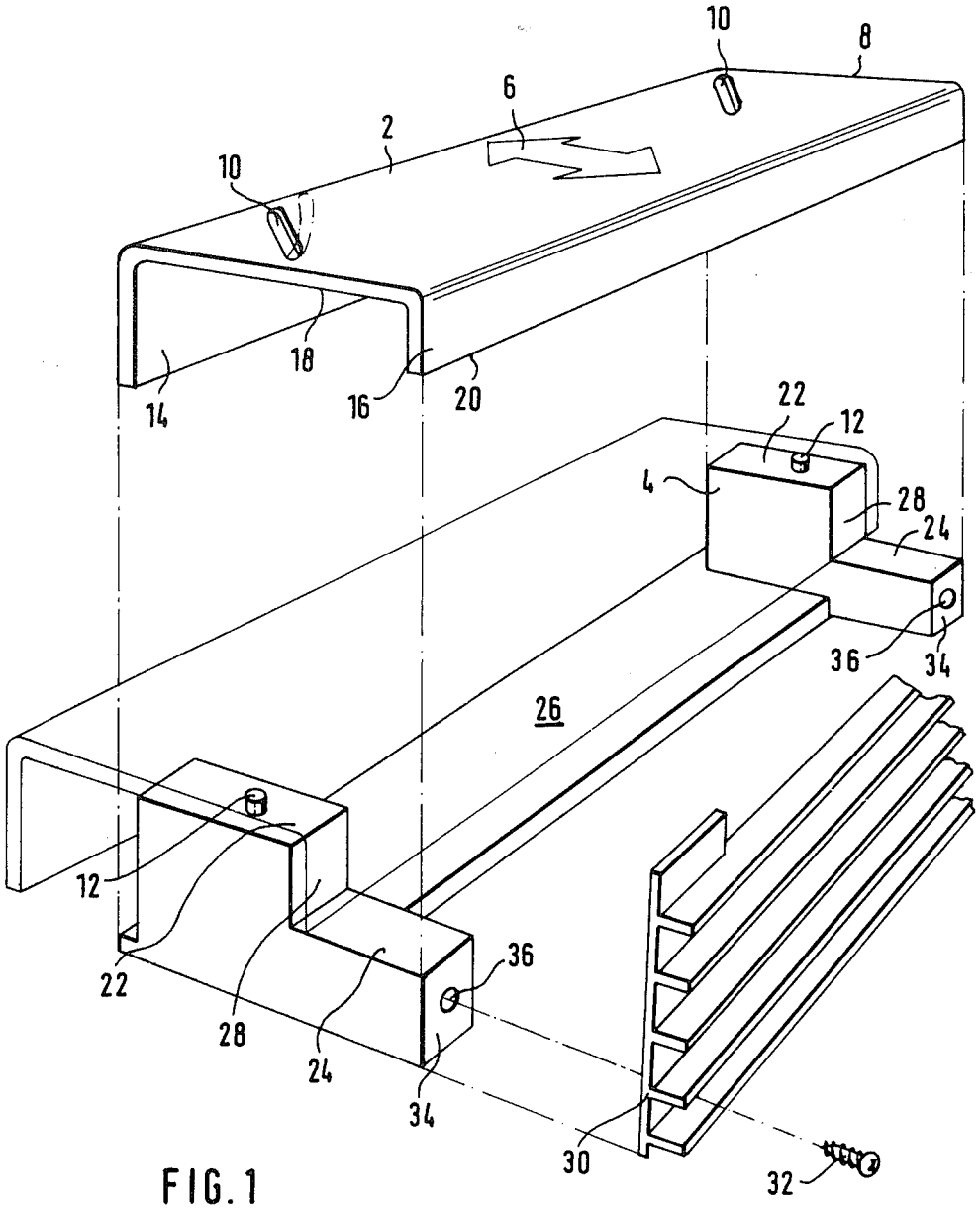
FIG. 1 is an exploded view of one embodiment comprising a U-shaped slide.

Facing grid 30 has a second stop-surface 58 extending over approximately the lower third of overall height H, against which leg 16 and sealing surface 60 of slide 2 bear. Due to the U-shaped design of the said slide and the two stationary stop-surfaces 52, 58 secured to frame 38, a double seal is obtained. Also provided is a spring element 62, one end of which is attached to slide 2, while the other end is connected to guide-element 4 or, if necessary, directly to frame 38, in order to hold the said slide mainly in the closed position shown. The wind-pressure indicated by arrow 54, like spring-element 62, acts upon the slide in such a manner as to force it into the closed position.

Figure 2:
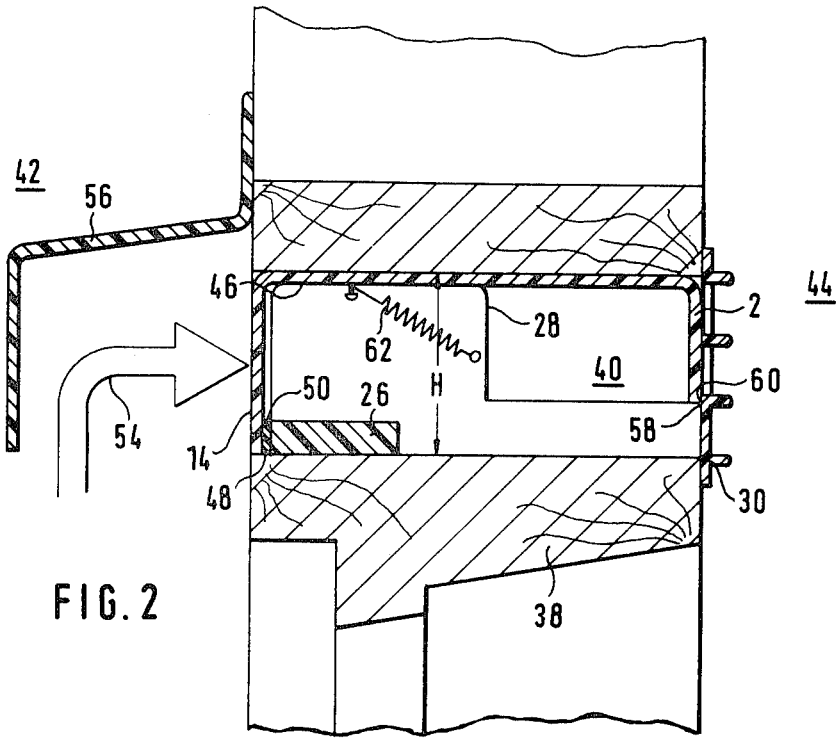
FIG. 2 is a vertical section through the embodiment according to FIG. 1, with the slide in the closed position.
Figure 3:
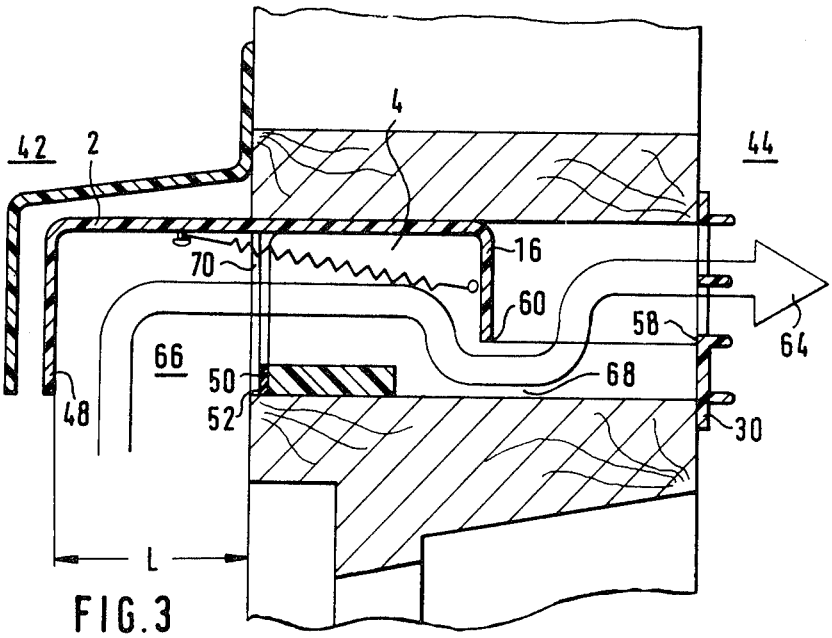
FIG. 3 is a section similar to that in FIG. 2, but with the slide in the open position.

FIG. 3 shows the ventilating unit with slide 2 in the open position, in which the flow-duct is exposed and there is a connection between exterior 42 and interior 44. This permits a flow of air in the direction of arrow 64. Obviously air may also flow in the opposite direction. Based upon the direction of flow indicated by the arrow, slide 2 has been brought from the closed position represented in FIG. 2 into the open position in FIG. 3 by moving substantially in a direction opposite to the direction of flow. Suitable actuating devices are provided to this end, which need not be explained here. The flows of air meanders, approximately as shown by arrow 64, through the ventilating unit, the said deflections producing a substantial reduction of noise between the exterior and the interior. In this connection it is of considerable importance to avoid any appreciable flow-resistance in area 66, i.e. in the air-inlet area, since slide 2 projects externally by an amount L which is equal to, or even greater than, overall height H of flow-duct 40. In contrast to this, a constriction is provided in central area 68 of the flow-duct 40, after which the flow of air passes into interior 44 through facing grid 30. Also visible on guide-element 4 is sealing element 70 which provides a reliable seal at the end of flow-duct 40 when the slide is in the closed position. It is expressly pointed out that, according to a preferred alternative design, second stop-surface 58 may be arranged, not upon an additional facing grid, but upon a connecting slat which is secured directly to end-faces 34, or may be made integral therewith.

Figure 4:
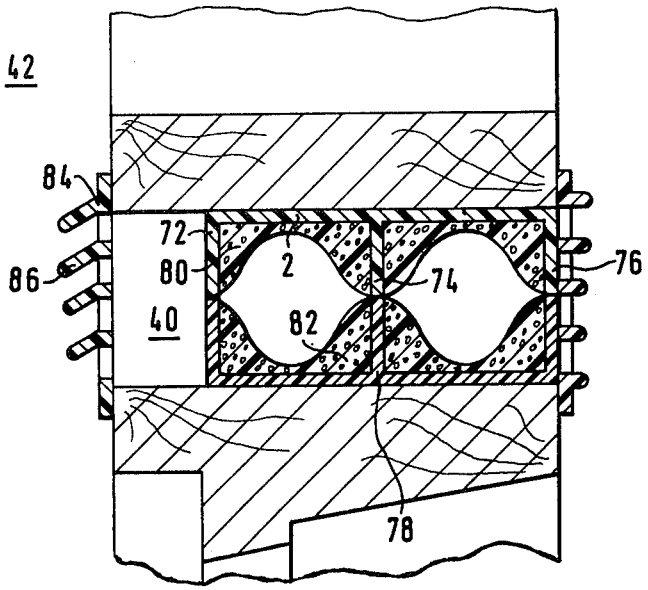
FIG. 4 is an embodiment in which the slide moves solely in the frame.

FIG. 4 illustrates diagrammatically an example of embodiment of a ventilation unit in which, the slide 2, which is adapted to move in the direction of flow, comprises three legs 72, 74, 76. Arranged in flow-duct 40 is a component 78 attached to frame 38 which is of basically the same construction as slide 2. In the closed position shown, the legs of slide 2 and of component 78 face in opposite directions. Slide 2 and component 78 have between their legs a lining 80, 82 of sound-insulating material, the surfaces of the said linings being rounded and therefore not offering too much resistance to the flow of air in the open position. A facing grid 84, with weather-stripping 86, faces the outside 42. In this construction, the slide 2 is arranged completely within flow-duct 40, and is also there in the open position. It should be emphasized that in this construction the sealing surfaces of the slide 2, in the closed position, are diametrically opposite to stop and sealing surfaces of component 78 secured to frame 38, there being practically no gap between the legs of slide 2 and of component 78. Obviously, corresponding openings are provided in lining 80 in the vicinity of the guide elements also provided at the end of the flow-duct.

I claim:

1. Air-ventilation unit for mounting in an opening across a frame between one side of the frame and the other to control air flow therebetween, said unit defining a flow duct and comprising:

an air control slide movable back and forth at least partly in the flow duct and having a central horizontal guiding top part and at least two parallel legs including first and second legs at the ends thereof extending downwardly into and across the flow duct;

stationary guide means for guiding the movement of the slide; and closure surface means at the lower ends of the legs and on the guide means and arranged for cooperating together in one position of the slide to close off the flow duct;

at least the second leg extending down into a portion only of the flow duct such that when the slide is moved away from said one position, air flows through the flow duct;

the stationary guide means comprising two guide elements each on one side of the flow duct and each having a step-like formation defining a high horizontal surface and a low horizontal surface separated by an upright stop surface, the central top part of the slide resting on and being guided by the high horizontal surfaces, an air stop wall being secured to the guide elements across the flow duct and arranged at the corresponding lower end portions of the guide elements adjacent the low horizontal surfaces thereof for stopping the second leg in abutting relation to the corresponding closure surface means of the second leg, to close the flow duct, the first leg being arranged at the corresponding side portions of the guide elements adjacent the high horizontal surfaces thereof and extending fully across the flow duct, a connecting element joining the guide elements, and the closure surface means of the first leg being arranged for abutting the connecting element in a closed position of the slide relative to the flow duct.

2. Unit of claim 1 wherein only the first and second legs are provided, and only the second leg extends down into a portion only of the flow duct.

3. Unit of claim 1, wherein the frame has an outside face and an inside face, and the slide is arranged for closing movement in a direction from the outside face to the inside face of the frame.

4. Unit of claim 1, wherein the slide is arranged for opening movement such that one of the legs is pushed relatively outwardly or inwardly of the corresponding confines of the frame for maximizing the opening of the flow duct.

5. Unit of claim 1, wherein the first leg extends over the full structural height of the flow duct while the second leg extends over a portion only of the height of the flow duct, and the slide is arranged for opening movement such that the first leg is pushed relatively outwardly or inwardly of the corresponding confines of the frame for opening the flow duct.

6. Unit of claim 5, wherein the second leg extends over only about two-thirds of the structural height of the flow duct.

7. Unit of claim 5, wherein at least one facing grid is provided for the flow duct and correspondingly at least one stop surface is provided on the facing grid.

8. Unit of claim 1, wherein coacting pin and slot means are provided on the slide and guide elements for guiding the movement of the slide.

9. Unit of claim 8, wherein the slot means are arranged at an angle to the flow direction of the flow duct for correspondingly angularly guiding the slide during its movement.

10. Unit of claim 8, wherein the slot means are curved for correspondingly curvingly guiding the slide during its movement.

11. Unit of claim 1, wherein a facing grid is provided for the flow duct and the guide elements contain fastener receiving recesses for receiving fasteners for attaching the facing grid thereat.

12. Unit of claim 1, wherein a spring element is arranged for maintaining the slide normally in closed position.

* * * * *